United States Patent [19]

Tokutomi

[11] 4,000,955

[45] Jan. 4, 1977

[54] FAN WITH WIDE CURVED BLADES

[76] Inventor: Kiyoshi Tokutomi, 490 N. 5th St., San Jose, Calif. 95112

[22] Filed: Sept. 22, 1975

[21] Appl. No.: 615,486

[52] U.S. Cl. ..... 415/183; 416/243; 415/208

[51] Int. Cl.[2] ..... F04D 29/44

[58] Field of Search ..... 416/243, 176, 177; 415/208, 183

[56] References Cited

UNITED STATES PATENTS

| | | | |
|---|---|---|---|
| 691,514 | 1/1902 | Whitney | 416/243 |
| 1,683,949 | 9/1928 | Bergdoll | 415/183 |
| 1,795,588 | 3/1931 | Wilson | 415/183 |
| 2,024,700 | 12/1935 | Millar | 416/243 |

FOREIGN PATENTS OR APPLICATIONS

| | | | |
|---|---|---|---|
| 764,860 | 3/1934 | France | 416/176 |
| 889,233 | 9/1953 | Germany | 416/176 |
| 389 | 1882 | Italy | 416/243 |
| 1,026 | 1864 | United Kingdom | 416/243 |
| 433,618 | 8/1935 | United Kingdom | 416/243 |
| 808,740 | 2/1959 | United Kingdom | 416/176 |

*Primary Examiner*—Henry F. Raduazo
*Attorney, Agent, or Firm*—Charles L. Botsford

[57] ABSTRACT

A fan with a plurality of wide curved blades that eliminate air space and overlapping between blades has improved efficiency in that each of the blades is of a curvature that deflects most, if not all, of the air hitting the blades toward, and then forward along, the longitudinal axis of the fan.

6 Claims, 8 Drawing Figures

FIG.1
PRIOR ART
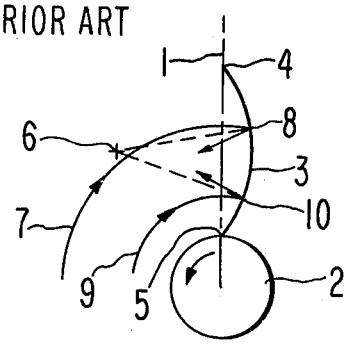
FIG.2
PRIOR ART
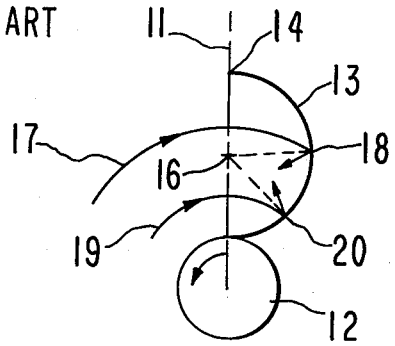
FIG.5
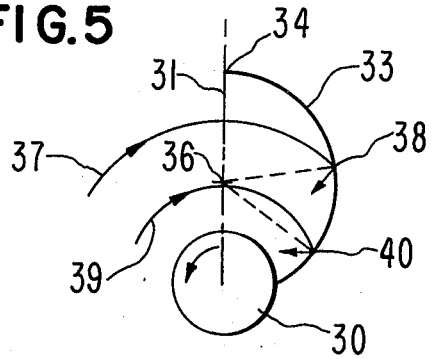
FIG.3
PRIOR ART
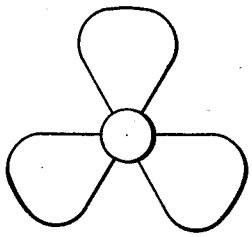
FIG.4
PRIOR ART
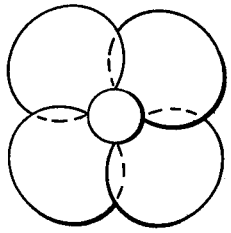
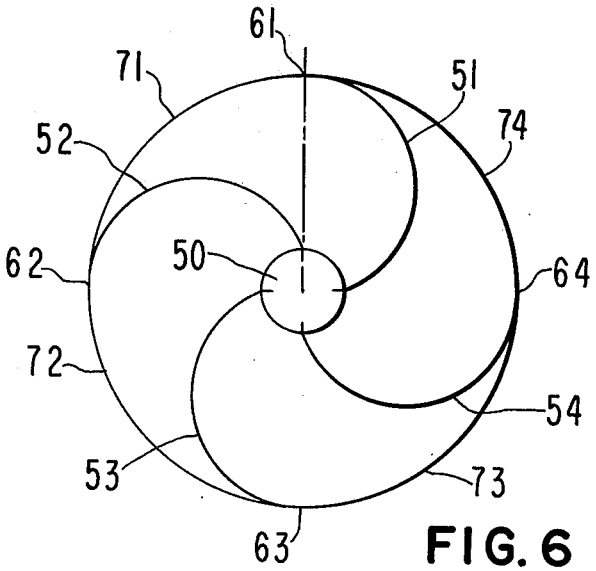
FIG. 6

FAN WITH WIDE CURVED BLADES

BACKGROUND OF THE INVENTION

1. Field of the Invention

This invention relates to an improved device in the area of fans, blowers, propellers, screws, and the like. In particular, this invention relates to a device having a rotating shaft wherein compressed air is generated and pushed forward parallel to the longitudinal axis of the shaft.

2. Description of the Prior Art

Devices such as fans and blowers are well known for use in generating an air stream. Also well known are devices that are powered by wind and by streams of water; for example, windmills, water wheels, and turbines. Disadvantages of the above devices consist of unwanted diffusion of air hitting a fan, the need for a special cover for the blower, and loss of operating efficiency arising from the alignment of blades in a fan.

A fan typically comprises a rotatable shaft onto which are mounted a number of blades spaced apart from each other. When the shaft rotates, the blades turn and push a mass of air in the direction of the longitudinal axis of the shaft. The amount of air moved in a period of time is proportional to the angle at which each blade is mounted with respect to the longitudinal axis of the shaft, and the shaft's speed of rotation. For example, the closer the face of the blade is to an angle perpendicular to the longitudinal axis of the shaft, the smaller is the amount of air deflected by the blade as the shaft rotates. A decrease in the blade angle with respect to the shaft means that the blade pushes a greater mass of air as the shaft rotates. Air hitting a moving blade is deflected from the blade at an angle approximately similar to the incident angle of air hitting the blade. Air hitting the fan blade at different angles is deflected in turn from the blade at different angles; some of the air deflected from the moving blade tends to be diffused, an undesirable characteristic for many applications.

One can cause a decrease in the diffusion of air by the use of curved blades on the fan, a portion of which is shown in FIG. 1. In order to help understand the characteristics of a curved-blade fan, one can visualize an imaginary line between the center of the shaft 2 to which the blade 3 is attached, and the outermost tip 4 of blade 3 farthest from the shaft 2. Typically the blade 3 is attached to the shaft 2 at a point 5 that lies along the imaginary line 1. In some fans, the radial center 6 of the curved blade 3 is at a point away from the imaginary line 1, so that some of the air hitting the blade 3 is diffused. For example, as the shaft 2 turns in a counter clockwise direction, air 7 hitting the upper half of the curved blade 3, such as at point 8, is deflected toward the shaft 2. However, air 9 hitting the lower half of the curved blade 3, such as at point 10, is deflected away from shaft 2 and becomes diffused.

In other fans, the radial center 16 of the curved blade 13 is on the imaginary line 11 from the center of the shaft 12 to the outermost edge 14 of the blade 13, as indicated in FIG. 2. The curvature of such a blade 13 often approaches that of a half circle. Much of the air 17 hitting the curved blade 13, such as at point 18, is deflected inside the curvature toward the shaft 12, as the latter turns in a counter clockwise direction. However, some air 19 hitting the lower half of the curved blade 13, such as at point 20 is still deflected away from, rather than toward, the shaft 12. For maximum efficiency, it is desirable that the blade deflect most if not all of the air hitting it toward the shaft, and reduce, or eliminate, the quantity of diffused air, so that most or all of the air covered by the blade curvature moves in the direction desired. None of the prior-art fans are able to accomplish this objective.

Efficiency of a fan is increased when most or all of the air hitting the fan blades is used, the air moves in the direction desired after being deflected, and little or no air moving the direction of the fan manages to escape. Standing in front of a typical fan and looking in the direction of the longitudinal axis of its shaft, one sees space between the fan blades, as indicated in FIG. 3. Consequently, air at this space is not used until the blades move into the empty space, resulting in a waste of the available air in the vicinity of the fan. Furthermore, a new open air space appears after the blade moves away until the next blade moves into this space. Moreover, when this kind of fan is used as a windmill, some of the wind can escape through this space before the blades move into the space, resulting in a waste of the wind.

Another kind of fan has blades aligned so that a portion of the back of one blade overlaps a portion of the front of another blade, as shown in FIG. 4. The overlapping blades prevent the deflected air from moving in the direction desired. As the blades move, some of the air deflected by one blade hits the overlapping portion of the other blade, which causes a loss of concentration of deflected air. Thus a fan is needed that prevents the waste of the space due to a gap between the blades, while at the same time preventing loss of the deflected air due to blades overlapping one another.

A cover over the fan has been used in some prior-art devices to control the flow of air and decrease diffusion. Inlets in the cover allow air to be pulled in, usually by use of a rotating shaft on which are mounted a number of spaced scoops, cups, or blades. A narrow outlet is provided in the cover through which the moving scoops or blades push the air, which becomes a narrow air stream. For some applications, however, a cover to channel the air flow is either inconvenient, or expensive, or both.

Thus there is a need for a device with a rotating shaft that generates an air stream which moves forward parallel to the longitudinal axis of the shaft, that reduces the amount of diffused air, that increases the efficiency of operation by using all of the air, that does not allow air to escape nor rebound from one blade to another, and that eliminates the need for a special cover to control air flow.

SUMMARY OF THE INVENTION

Briefly, the device according to the invention comprises a rotatable shaft on which are mounted a plurality of wide curved blades spaced apart from each other. Each blade extends from the shaft in an arc having a curvature such that the radial center of the arc lies along an imaginary line extending between the center of the shaft and the outer tip of the arc farthest from the shaft. Each blade is attached to the shaft at a point approximately 90°, that is, one-quarter turn, away from where the imaginary line crosses the outer perimeter of the shaft. In addition, the outer edge of each blade is aligned at approximately a 45° angle with the longitudinal axis of the shaft. Each blade travels a distance of approximately four times the distance between the center of the shaft and the outer tip of the arc when the shaft is rotated one revolution, that is, for one revolution of the shaft, the pitch is four times the radius of the fan. Moreover, the length of each blade from front to back along the shaft is approximately the pitch of the blade divided by the number of blades attached to the shaft. An alternative embodiment of the device comprises a funnel-shaped adaptor having special fins inside for use with the device of the invention when the latter is used as a windmill, water wheel, or turbine.

The invention overcomes the limitations and disadvantages of prior-art fans, in that each blade of the invention deflects more air towards the shaft compared with blades of prior-art fans, and all air covered by the curvature of the blades is then forced to move forward parallel to the longitudinal axis of the shaft without unwanted diffusion. Moreover, unwanted overlapping between portions of the blades is eliminated so that air deflected off one blade does not hit another blade. In addition, unwanted space between blades when viewed toward the longitudinal axis of the shaft is eliminated so that air cannot escape or be wasted.

BRIEF DESCRIPTION OF THE DRAWINGS

FIG. 1 is a simplified cross-sectional view of a portion of a prior-art fan wherein the radial center of the arc of the curved blade is outside an imaginary line between the center of the shaft and the outer tip of the blade.

FIG. 2 is a simplified cross-sectional view of a portion of a prior-art fan wherein the radial center of the arc of the curved blade is located on an imaginary line between the center of the shaft and the outer tip of the blade.

FIG. 3 is a simplified two-dimensional view of a portion of a prior-art fan looking toward the longitudinal axis of the shaft.

FIG. 4 is a simplified two-dimensional view of a portion of a prior-art fan wherein a portion of each blade overlaps another blade.

FIG. 5 is a simplified cross-sectional view of a portion of the invention wherein the blade is attached to the shaft at a point approximately 90° away from an imaginary line between the center of the shaft and the outer tip of the blade.

FIG. 6 is a simplified two-dimensional front view of the invention which shows neither open air space nor overlapping between the blades.

DESCRIPTION OF THE PREFERRED EMBODIMENTS

Figure 7:
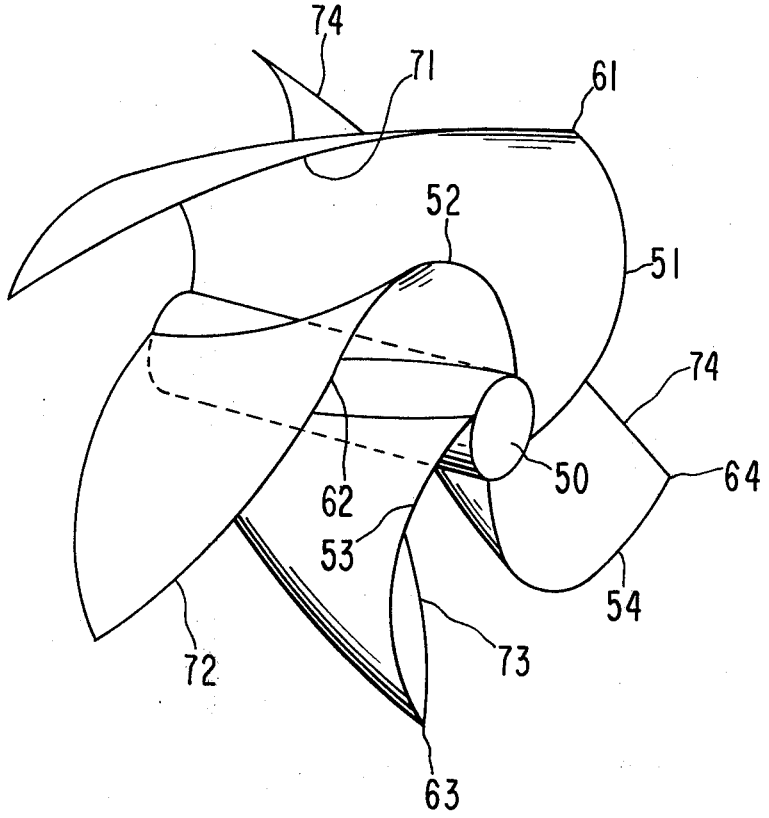
FIG. 7 is a simplified isometric drawing of the invention.

Referring to FIG. 5, which is a simplified cross-sectional view of only a portion of the device of the invention, a rotatable shaft 30 has mounted thereon a blade 33. Blade 33 extends from shaft 30 in an arc of a curvature wherein the arc's radial center 36 lies along an imaginary line 31, which extends between the center of shaft 30 and the outer tip 34 of blade 33 farthest from shaft 30. Blade 33 is attached to shaft 30 at a point approximately 90°, that is, one-quarter revolution of shaft 30, away from imaginary line 31. An imaginary plane, formed by curved blade 33 between its place of attachment at shaft 30 and outer tip 34, intersects the longitudinal axis of shaft 30 at approximately a right angle.

In general, air hitting a surface is deflected at an angle approximately the same as the incident angle. The curvature of blade 33 as well as the location of where blade 33 is attached to shaft 30 causes most, if not all, of the air hitting blade 33 to be deflected toward and concentrated in the vicinity of shaft 30, rather than diffused away from shaft 30, as in some prior-art devices. For example, air 37 hitting blade 33 at point 38 is deflected toward shaft 30 as is air 39 hitting blade 33 at point 40. Neither of the prior-art curved blades of FIGS. 1 and 2 deflect as much air toward the shaft as the quantity of air deflected by that of FIG. 5.

Referring to FIG. 6, which is a front view of the complete device of the invention, a plurality of wide curved blades, 51 through 54, are spaced apart and attached to rotatable shaft 50. As indicated in FIG. 6, there is neither open air space nor overlapping between blades 51 through 54 when the device is viewed in the direction of the longitudinal axis of shaft 50. Each blade 51 through 54 deflects air toward shaft 50 in a manner similar to that of blade 33 in FIG. 5.

Each blade 51 through 54 has a respective outer tip 61 through 64 which forms an imaginary plane between the place of attachment of the respective blade to shaft 50 and the blade's respective outer tip 61 through 64. Each of these imaginary planes intersects the longitudinal axis of shaft 50 at approximately a right angle. Each of the blades 51 through 54 extends from its respective outer tip 61 through 64 back at approximately a 45° angle to the imaginary plane mentioned above to form a respective outer leading edge 71 through 74 that also is at approximately a 45° angle with the longitudinal axis of shaft 50. Respective leading edge 71 through 74 of each blade 51 through 54 thus forms a spiral-like configuration with respect to shaft 50, as shown in FIG. 7. The length of each blade 51 through 54 along shaft 50 is at least as along as the pitch of the blade divided by the number of blades. All of the blades 51 through 54 are constructed so that there are no open air gaps between blades, when the device is viewed from the front toward the longitudinal axis of shaft, and air moving toward the blades cannot escape from being deflected by blades 51 through 54. Moreover, none of the blades 51 through 54 overlap each other, so that air deflected from one blade does not hit the backside of an adjacent blade.

One revolution of shaft 50 causes each blade 51 through 54 to travel a distance of approximately four times the radius of the fan, which is the distance between the center of the shaft 50 and the outer tip of a blade, such as outer tip 56 of blade 51. As shaft 50 rotates, blades 51 through 54 push air towards shaft 50 and then forward parallel to longitudinal axis of shaft 50 without diffusion, because the outer leading edges 71 through 74 of blades 51 through 54 are aligned at approximately a 45° angle with the longitudinal axis of shaft 50.

Figure 8:
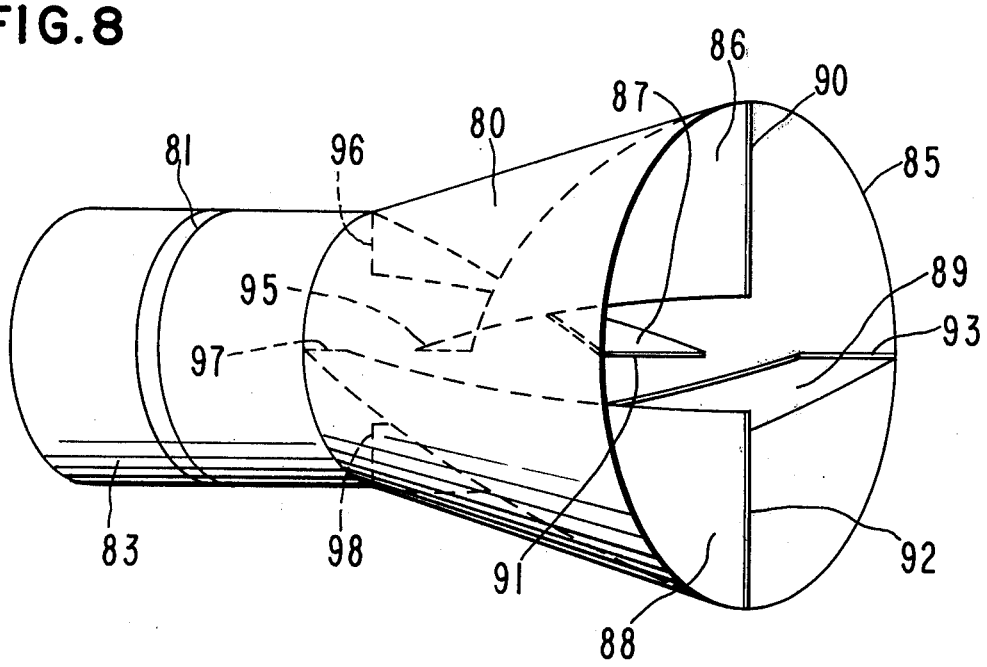
FIG. 8 is a simplified isometric drawing of an alternative embodiment of the invention comprising a collector with special fins for use with the fan of the invention.

Referring to FIG. 8, an alternative embodiment of the invention comprises an air collector 80, preferably in the shape of a funnel, located in front of the fan of FIGS. 6 and 7. The narrow open end 81 of collector 80 points towards the fan, indicated in FIG. 8 by a cylinder 83. The wide open end 85 of collector 80 points away from the fan 83. Located on the inside of collector 80, starting at the wide open end 85, are a plurality of fins 86 through 89, portions of which are indicated by dashed lines inside collector 80. Each fin 86 through 89 is attached to and extends along the interior of collector 80 in a twisted-like manner, so that the ends of the fins nearest the wide end 85 of collector 80, such as ends 90 through 93, are out of phase with the respective opposite ends of the fins, such as ends 95 through 98 of collector 80, by approximately 360° divided by the number of fins. For example, with four fins in collector 80, fin 86 is shown with an end 90 near wide end 85 of collector 80 in a vertical position. The other end 95 of fin 86 near narrow end 81 of collector 80 is in a horizontal position. The twisted manner of fins 86 through 89 causes air entering and passing through collector 80 to twist. The velocity of the twisting air is increased compared to air moving through a funnel without fins.

After the twisting air exists collector 80 at narrow end 81, the air hits the blades of fan 83, causing the fan to turn rapidly. For some applications, special extenders (not shown) can be attached to the wide end 85 of collector 80 to increase the opening at end 85, enabling air entering collector 80 to do so in a smooth manner. The extenders would not affect the location of fins 86 through 89 inside the collector.

I claim:

1. A rotating device in combination with an air collector comprising:

a rotatable shaft having a longitudinal axis;

a plurality of blades spaced apart mounted on the shaft, each blade extending from the shaft in an arc of a curvature wherein the radial center of the arc lies along an imaginary line extending between the shaft center and the outer tip of the arc farthest from the shaft, each blade being attached to the shaft at a point approximately 90° away from the imaginary line for a particular blade; and a funnel-shaped air collector, having a wide open end and a narrow open end, with a plurality of spaced fins attached to a portion of and extending through the interior of the collector, said fins starting at the wide end of the collector and extending toward the narrow end, with the two ends of each fin being aligned so that they are out of phase with each other by approximately 360° divided by the number of fins in the collector, said collector adjacent to said plurality of blades with the narrow end of said collector pointing toward the blades.

2. Device of claim 1 wherein each blade between the place it is attached to the shaft and its respective outer tip defines an imaginary plane that intersects the longitudinal axis of the shaft at approximately a right angle.

3. Device of claim 1 further defined by each blade having an outer leading edge that extends back from its respective outer tip at approximately a 45° angle with the longitudinal axis of the shaft, so that each outer leading edge forms a spiral-like configuration with respect to the shaft.

4. Device of claim 1 further defined by the pitch of each blade along the shaft being approximately four times the distance between the center of the shaft and the outer tip of the blade arc, during one full revolution of the shaft.

5. Device of claim 1 wherein the depth of each blade from front to back is the pitch of the blade divided by the number of blades.

6. Device of claim 1 further defined by an edge of each blade extending up to but not past an edge of an adjacent blade, so that open air space between blades is eliminated, when the device is viewed toward the longitudinal axis of the shaft, and at the same time overlapping between the back of a blade and the front of an adjacent blade is prevented.

* * * * *